United States Patent [19]

Suzuki et al.

[11] Patent Number: 4,613,310

[45] Date of Patent: Sep. 23, 1986

[54] OUTBOARD MOTOR

[75] Inventors: Tomonori Suzuki, Hamamatsu; Makoto Toyohara, Shizuoka, both of Japan

[73] Assignee: Sanshin Kogyo Kabushiki Kaisha, Iwata, Japan

[21] Appl. No.: 663,334

[22] Filed: Oct. 22, 1984

Related U.S. Application Data

[63] Continuation of Ser. No. 405,916, Aug. 6, 1982, abandoned.

[30] Foreign Application Priority Data

Aug. 25, 1981 [JP] Japan ..... 56-132996

[51] Int. Cl.[4] ..... B63H 21/00

[52] U.S. Cl. ..... 440/76; 440/900; 440/77; 440/2

[58] Field of Search ..... 123/185 A; 440/77, 900

[56] References Cited

U.S. PATENT DOCUMENTS

| | | | |
|---|---|---|---|
| 1,738,772 | 12/1929 | Harry | 440/2 |
| 2,627,181 | 2/1953 | Kiekhaefer | 440/900 |
| 2,649,848 | 8/1953 | Armstrong | 440/2 |
| 2,891,259 | 6/1959 | Perry | 440/61 |
| 3,090,463 | 5/1963 | Yanda | 440/77 |
| 3,092,186 | 6/1963 | MacLean | 440/900 |
| 3,153,397 | 10/1964 | Mattson et al. | 440/76 |
| 3,358,668 | 12/1967 | Post et al. | 440/77 |
| 3,955,526 | 5/1976 | Kusche | 440/77 |
| 4,096,919 | 6/1978 | Thompson | 123/185 A |
| 4,257,367 | 3/1981 | Fujikawa | 123/179 SE |
| 4,348,194 | 9/1982 | Walsh | 440/77 |
| 4,355,986 | 10/1982 | Stevens | 440/53 |

FOREIGN PATENT DOCUMENTS

| | | | |
|---|---|---|---|
| 821728 | 4/1981 | U.S.S.R. | 123/185 A |

OTHER PUBLICATIONS

Johnson (OMC) Owners Manual for Super Sea Horse 55, 1969.

*Primary Examiner*—Trygve M. Blix
*Assistant Examiner*—Edwin L. Swinehart
*Attorney, Agent, or Firm*—Ernest A. Beutler

[57] ABSTRACT

An improved outer cowling arrangement for the power head of an outboard motor in which both the tray and top housing are formed from a synthetic resin for improving silencing. To insure a good fit and sealing, a supporting member and retaining member are affixed to each other and the supporting member is carried by one of the portions. Releasable latching means are carried by the other portion to engage the retainer member for holding the cowling portions together. The top housing has an inclined forward face in which a panel is positioned for passing the starting handle and starting rope. A guide defines a path of movement for the starting rope that is perpendicular to this inclined surface so that the motor can easily be started from a higher level, for example, when used as an auxiliary power source for a sailboat.

6 Claims, 6 Drawing Figures

2
44
43
53
14
16
17
11
18
19

67
54
53
11
44
43
14
16
12
13
17
15

OUTBOARD MOTOR

This application is a continuation of application Ser. No. 405,916, filed Aug. 6, 1982, now abandoned.

BACKGROUND OF THE INVENTION

This invention relates to an outboard motor and more particularly to an improved cowling construction for the power head of such a motor.

Frequently, outboard motors are employed as auxiliary power units for sailboats. In many such installations, particularly with larger sailing craft, the outboard motor is carried by the stern of the sailing vessel at a level considerably lower than the rear deck. As a result, in order to pull the recoil starter associated with conventional outboard motors, the operator must pull the starting rope at an angle to that for which it is normally designed. That is, most outboard motors employ a recoil starter in which the starting rope is pulled in a substantially horizontal direction. However, when the outboard motor is used as an auxiliary power unit for a sailing vessel, the starting rope must be pulled at an upwardly inclined angle due to the lower positioning of the motor relative to the rear deck on which the operator is positioned. As a result, it is more difficult to pull the starting rope and starting difficulties can well be encountered.

It is, therefore, a principal object of this invention to provide an improved starting arrangement for outboard motors rendering them more adaptable to use as auxiliary power units on sailboats.

It is a further object of the invention to provide an improved cowling unit for an outboard motor that facilitates starting when associated as a power unit for a sailing vessel.

It is yet a further object of this invention to provide an improved cowling unit for an outboard motor that facilitates starting when used as an auxiliary power unit, which offers an instrument panel and which also facilitates servicing of the motor.

One of the prime difficulties in the design of outboard motors is silencing. Since the power unit is positioned above the water level and in close proximity to the operator, noise can well be a problem. It has been conventional practice to enclose the power head within an outer cowling so as to, among other things, minimize the transmission of noise. The outer cowling associated with most outboard motors includes an upper cover and lower tray. Heretofore, it has been the practice to form at least the lower tray from metal so as to insure good sealing between the upper housing and the tray. Although the use of plastic such as synthetic resins can significantly improve silencing, such materials have not heretofore been used for the lower tray because of the difficulties of insuring good sealing, particularly when the material properties change with age.

It is, therefore, a further object of this invention to provide an improved outer cowling for an outboard motor.

It is another object of this invention to provide an outer cowling for an outboard motor that may be formed from synthetic resin and which will insure good sealing throughout the life of the unit.

SUMMARY OF THE INVENTION

A first feature of the invention is adapted to be embodied in an outboard motor construction having a power head with an outer cowling. In accordance with this feature of the invention, the outer cowling has an inclined portion extending upwardly and rearwardly to form a face that may be seen from above. A starter handle is accessible from the inclined portion of the outer cowling.

Another feature of the invention is adapted to be embodied in an outer cowling arrangement for the power head for an outboard motor or the like. Such an outer cowling and arrangement includes a lower tray portion formed from a synthetic resin and an upper housing portion also formed from a synthetic resin. A supporting member is affixed to one of the portions and in turn carries a retaining member. Releasable latch means are carried by the other of the portions and is engageable with the retaining member for holding the cowling portions together.

DETAILED DESCRIPTION OF THE PREFERRED EMBODIMENT

Figure 1:
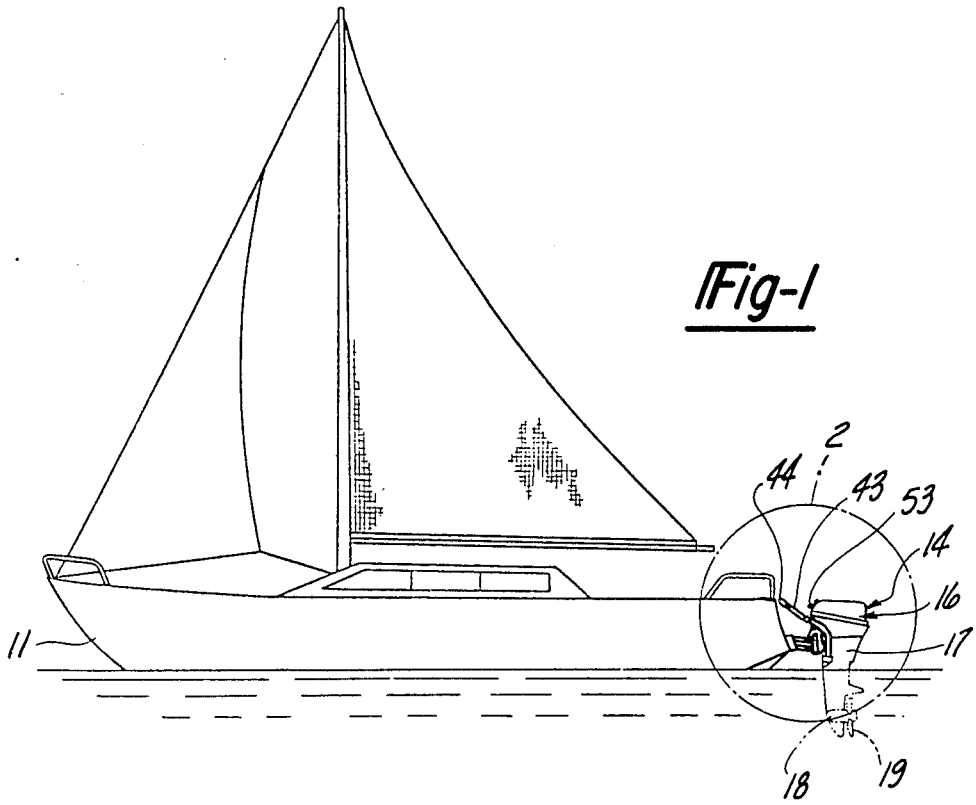
FIG. 1 is a side elevational view of a sailboat with an attached auxiliary power unit in the form of an outboard motor constructed in accordance with this invention.
Figure 2:
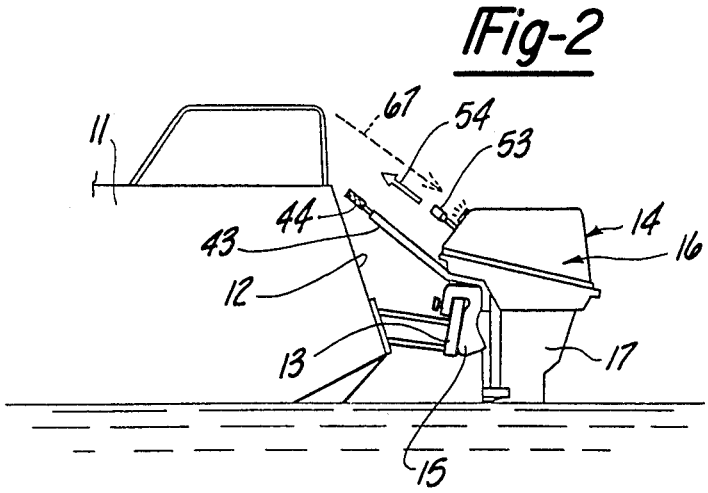
FIG. 2 is an enlarged view of the area encompassed by the circle 2 in FIG. 1.

Referring first to FIGS. 1 and 2, a sailing vessel such as a cruiser, is identified generally by the reference numeral 11. The sailing cruiser 11 has a stern 12 to which an outrigger 13 is affixed so as to detachably support an outboard motor constructed in accordance with this invention, indicated generally by the reference numeral 14.

The motor 14 includes a clamping assembly 15 for detachably affixing the motor 15 to the outrigger 13 or to the stern of a boat in a known manner. The motor 14 includes a power head assembly, indicated generally by the reference numeral 16, a driveshaft housing 17 and a lower unit 18 including a driven propeller 19.

Referring now to the remaining figures, the power head 16 includes an internal combustion engine, shown in phantom and indicated generally by the reference numeral 21. The engine 21 is contained within an outer protective cowling constructed in accordance with the invention and including a lower tray portion 22 and an upper cover portion 23. In accordance with the invention, the tray portion 22 and upper cover portion 23 are formed from a suitable plastic material such as a synthetic resin so as to improve the sound deadening and reduce the transmissions of sounds from the engine 21 to the occupants of the associated watercarft such as the sailboat 11.

Normally, it has been considered to be impractical to form both the lower tray portion and upper cover portion of the cowling from a synthetic resin. The reason for this has been the difficulty of obtaining effective sealing between two such resinous pieces, particularly when the resin ages and is subject to deformation. In accordance with this invention, an arrangement is provided wherein the tray portion 22 and cover portion 23 are affixed together by a intermediate member so as to improve the sealing throughout the life of the unit.

In accordance with the invention, a supporting member 24, formed from a more rigid material such as a metal, is affixed to the forwardmost portion of the tray portion 22 by means of threaded fasteners 25. The supporting member 24 has in turn affixed to it a retaining member, indicated generally by the reference numeral 26. The retaining member 26 is affixed to the supporting member 24 by means of threaded fasteners 27 and is also formed from a more rigid material such as metal. The retaining member 26 extends generally upwardly into the forwardmost portion of the top cover portion 22 and has a forwardly extending portion 28 that cooperates to form a latch assembly, in a manner to be described. The top cover portion 23 has an inclined forward face 29 for a reason to be described. The forward face 29 and side and rear portions of the cover 22 terminate in depending flange portions 31 to which a seal 32 is affixed. The seal 32 engages and seals a corresponding upper portion of the lower tray 22.

To affix the cover 23 to the tray 22, a resilient latch member 33 is affixed to the forwardmost depending flange 31 and is adapted to extend into a recess 34 formed in the retaining member 26 so as to underlie the portion 28 and afford a detachable connection between the forwardmost portion of the cover 23 and the tray 22 via the retaining member 26.

A retaining member 35 (FIG. 3) is affixed to the flange 32 of the rear portion of the top cover 23. A pivotable supported latch 36 is engaged with the retaining member 35. A threaded fastener 37 fixes the latch 36 to a shaft 38 journalled in the lower tray 22. A handle 40 is fixed to the outer end of the shaft 38 for operation of the latch between latched and unlatched positions so the retainer 35 and latch 36 form a releasable latching assembly 39.

The lower tray 22 is formed with a central opening in which a gasket 41 is formed so as to provide sealing engagement with a flange 42 formed at the upper end of the driveshaft housing 17.

The outboard motor 14 is provided with a steering tiller 43 (FIGS. 1 and 2) that extends forwardly of the motor. In addition, a rotatable throttle handle 44 is positioned at the forward end of the tiller 43 for throttle control of the engine 21 in a known manner.

Figure 3:
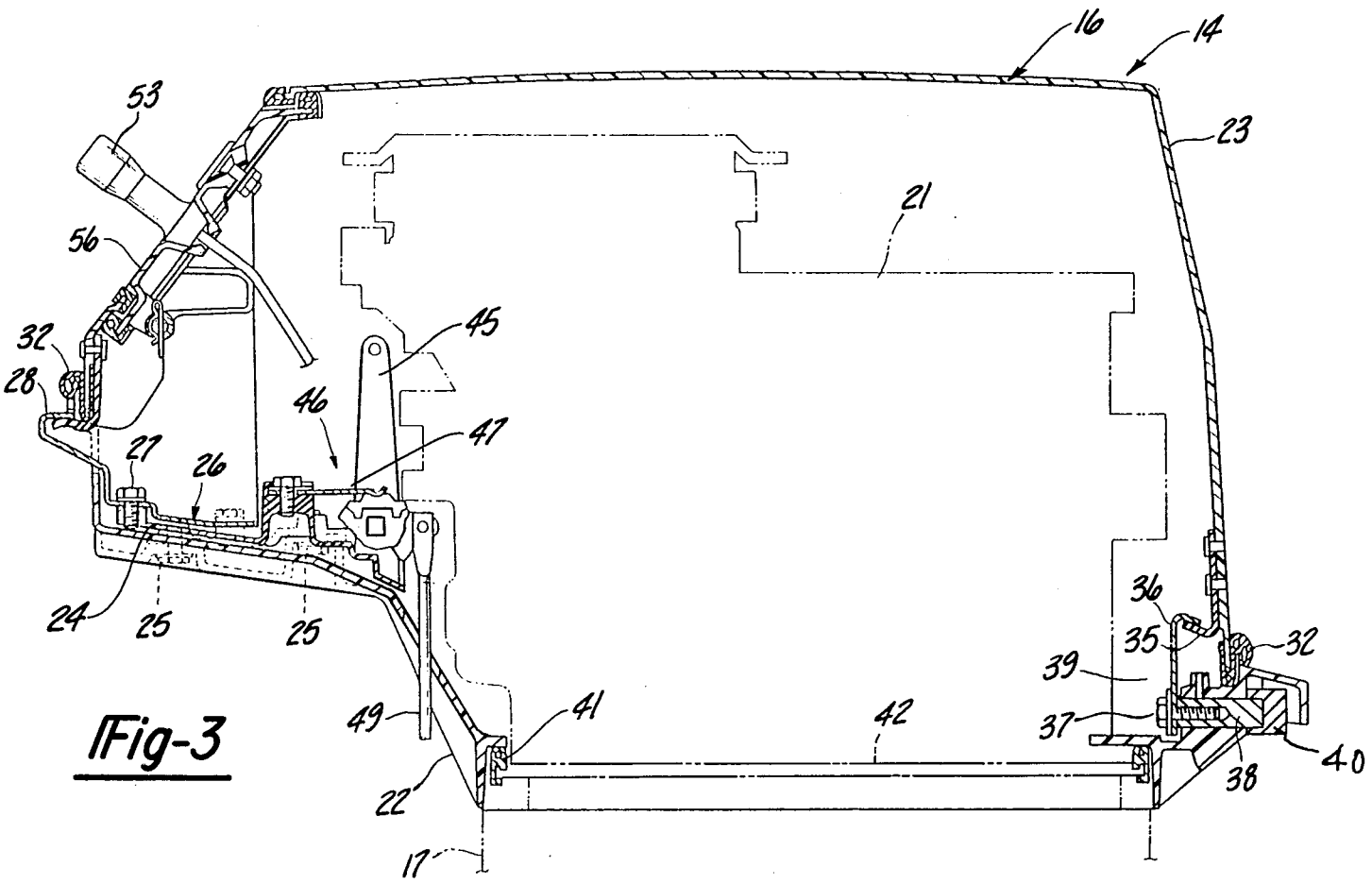
FIG. 3 is a further enlarged cross-sectional view showing the outer cowling arrangement associated with the outboard motor.

A shift mechanism is also employed that includes a control lever 45 (FIG. 3) that is operated in a known manner. The shift lever 45 is movable between a neutral position, as shown in FIG. 3, and a forward or reverse position. A detent mechanism 46 including a leaf spring 47 that is affixed to the supporting member 24 by means of a threaded fastener 48 is provided for retaining the shift lever 45 in each of its three positions. The lever 45 is connected to the transmission mechanism in the lower unit 28 (not shown) by means of a shift control rod 49.

As has been noted, the cover portion 23 has a face 29 that is inclined upwardly and rearwardly when the motor 14 is attached to the boat 11. The reason for this may be best understood by reference to FIGS. 1 and 2 as well as the remaining figures. The engine 21 is provided with a conventional recoil starter mechanism, indicated generally by the reference numeral 51, that is operated by means of a starter rope 52. With a conventional outboard motor arrangement, the starter rope 52 extends generally horizontally through the front face of the outer cowling and terminates at its starter handle 53. Such a horizontal arrangement is not suitable when the motor 14 is used to power a boat such as a sailboat 11. As may be readily seen from FIGS. 1 and 2, an operator standing on the deck of the boat adjacent the transom 12 must reach downwardly to have access to the starting handle 53. Thus, if the starting handle 53 and rope 52 are normally operated in a horizontal manner, it will be necessary for the operator to pull the handle 53 upwardly to clear the top of the transom 12. With conventional arrangements, this is awkward and furthermore reduces the effectiveness of the operator on operating the starter 51 to give rise to starter difficulties. In accordance with this invention, however, the starting rope may be pulled upwardly in the direction of the arrow 54 in FIG. 2 so as to effect starting due to an internal guide in the mechanism which will cause the normal starting direction of the rope 52 to follow the path of the arrow 54. This mechanism will now be described.

The sloping front side 29 of the top cover 23 is formed with an opening, indicated generally by the reference numeral 55. The opening 55 is normally closed by a control or operational panel 56. The panel 56 is formed with an integral hinged portion 57 that is pivotally connected to the retainer 26 by means of a pivot pin 58. The pivot pin 58 is held in position by means of a retaining pin 59. A seal 61 carried by the operational plate 56 and a seal 62 carried by the cover 23 around the opening 55 provide a water tight seal when the operational plate 56 is in its normal closed position. The plate 56 is maintained in this position by means of one or more threaded fasteners 63 cast into the plate 59 and nuts 64 that underlie the retainer 26.

The forward portion of the cover plate or operational board 56 is provided with a central opening 65 through which the starter rope 52 extends. Adjacent to the location of this opening when the board 56 is in its closed position, a guide 66 formed integrally with the retainer 26 engages the rope 52 and redirects its motion so that it will move along the line defined by the arrow 54 when the engine is started. Thus, no mechanical advantage will be lost and operation of the starter 51 from a higher level will be facilitated.

Figure 6:
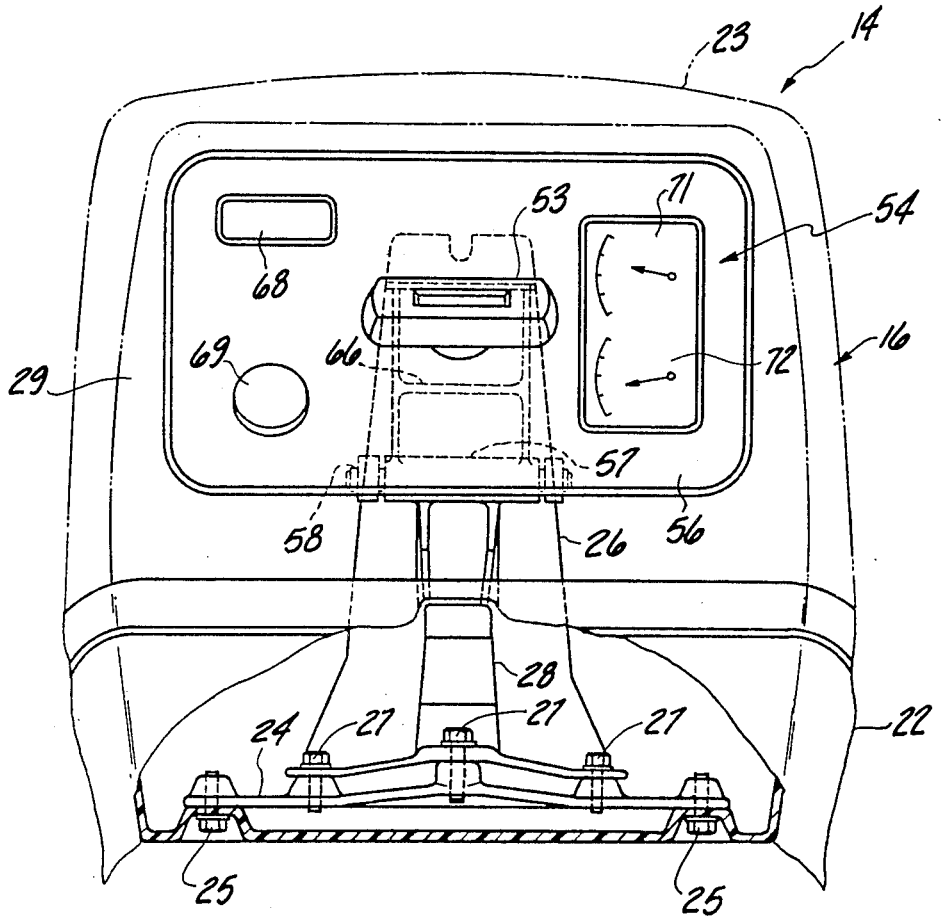
FIG. 6 is a front elevational view of the outer cowling unit, with a portion broken away, to more clearly show the construction.

The panel 56 may, in addition to affording ease of operation of the starting handle 53, carry a number of instruments for indicating the condition of the engine 21. Because of the inclined angle of the panel 56 and the top cowling portion 29, these instruments may be readily viewed from an operator on the deck of the boat along the sight line 67 (FIG. 2). Such instruments are shown in FIG. 6 and may comprise an oil indicator 68, a stop switch 69, a tachometer 71 and a temperature gauge 72. Of course, other instruments may readily be used in conjunction with the panel 56.

Figure 4:
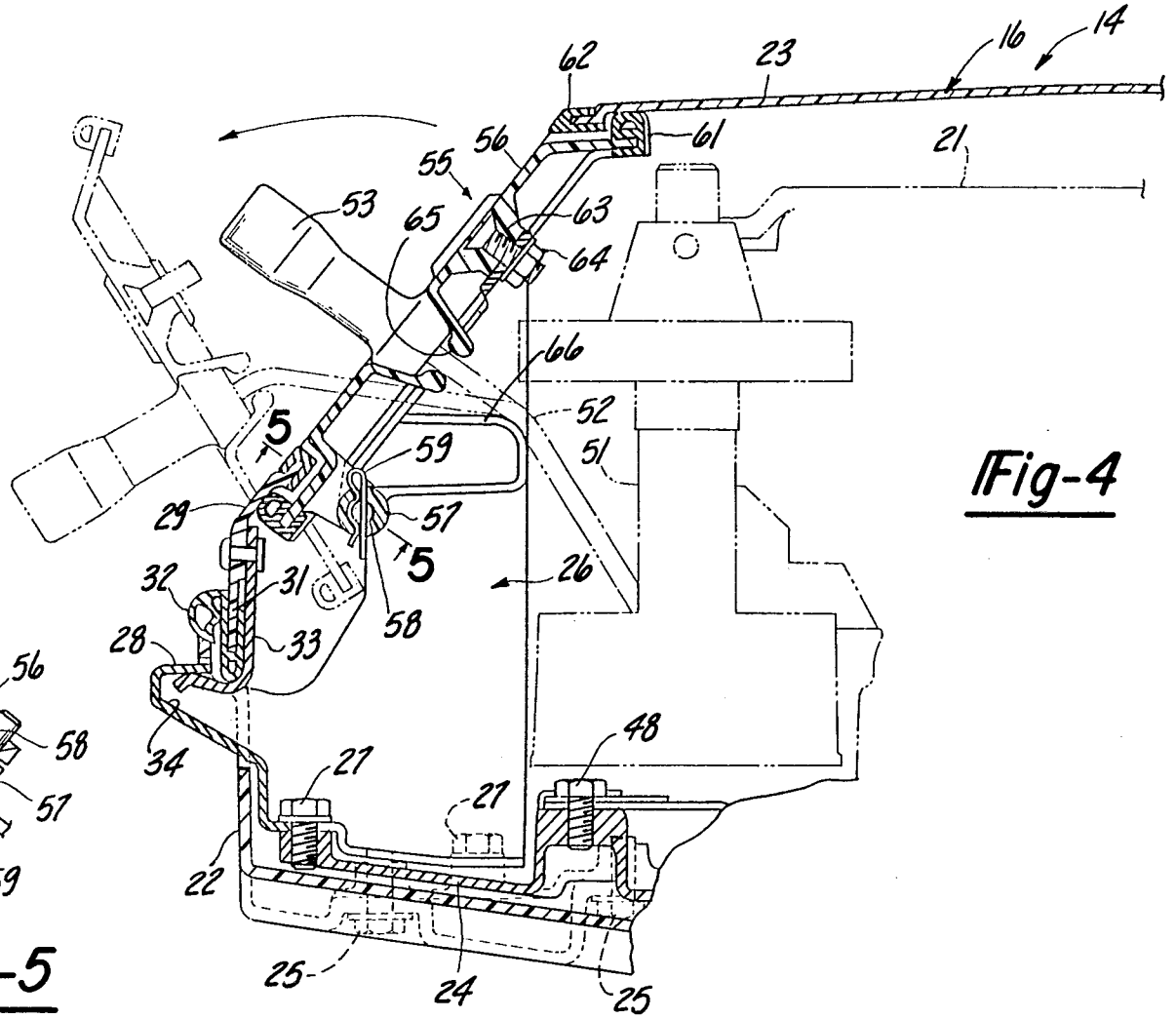
FIG. 4 is a yet further enlarged cross-sectional view of the forward portion of the outer cowling unit.
Figure 5:
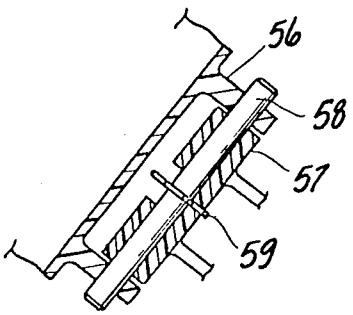
FIG. 5 is a cross-sectional view taken along the line 5—5 of FIG. 4.

It should be noted that the fact that the operational panel 56 is pivotally connected, not to the cover portion 23 but to the tray portion 22, permits ready detachment of the cover portion 23 for servicing of the engine. Furthermore, this simplifies the overall construction of the top cover portion 23. In addition, the operational panel 56 may be readily pivoted forwarded to the broken line position shown in FIG. 4 to afford access to the engine 21 and servicing by removal of the nuts 64. Thus, even though the panel 56 is inclined, it may be readily moved to a non-interferring forward position wherein servicing is facilitated.

Although there are advantages in having the operational panel 56 pivotal, it is to be understood that the invention may be employed in conjunction with arrangements wherein the panel 56 is rigidly carried by the retaining member 26. Also, although the invention is described in conjunction with the use of the motor 14 with a sailboat 11, it is to be understood that certain facets of the invention may be employed in conjunction with other types of watercraft. For example, the silencing afforded by having the tray 22 and cover portion 23 formed from synthetic resin with the attendant sealing improvement can be enjoyed with any outboard motor application. In addition, the inclination of the angle of operation of the starting handle 53 from the horizontal may be enjoyed in certain other arrangements as can the inclination of the panel on which the instruments are provided. Various other changes and modifications may be made without departing from the spirit and scope of the invention, as defined by the appended claims.

We claim:

1. A power head arrangement for an outboard motor comprising an internal combustion engine and surrounding protective cowling adapted to be affixed to the upper portion of said drive shaft housing, said protective cowling comprising a tray portion adapted to underly the engine, a main cowling portion detachably affixed to said tray and adapted to substantially enclose the engine, said main cowling portion defining a forwardly facing opening disposed above said tray and in proximity to the engine, a front cover portion pivotally supported by said tray and movable between a closed position for closing said main cowling portion forwardly facing opening and an open position extending forwardly of said opening and affording access through said opening, and engine controlling means carried by said front cover portion and movable with said front cover portion during its pivotal movement.

2. A power head arrangement for an outboard motor as set forth in claim 1 wherein the engine control means comprises means for starting the engine.

3. A power head arrangement for an outboard motor comprising an internal combustion engine and surrounding protective cowling adapted to be affixed to the upper portion of said drive shaft housing, said protective cowling comprising a tray portion adapted to underly the engine, a main cowling portion detachably affixed to said tray and adapted to substantially enclose the engine, said main cowling portion defining a forwardly facing opening disposed above said tray and in proximity to the engine, a supporting member affixed to said tray contiguous to said forwardly facing opening and formed from a more rigid material than the tray, and a front cover portion pivotally supported by said supporting member and movable between a closed position for closing said main cowling portion forwardly facing opening and an open position extending forwardly of said opening and affording access through said opening.

4. A power head arrangement for an outboard motor as set forth in claim 3 further including latching means carried by the supporting member and cooperative with the front cowling member for latching the front cowling member in its closed position.

5. A power head arrangement for an outboard motor as set forth in claim 4 further including engine controlling means carried by the front cover portion and movable with the front cover portion during its pivotal movement.

6. A power head arrangement for an outboard motor as set forth in claim 5 wherein the engine control means comprises means for starting the engine.

* * * * *